US005152704A

United States Patent [19]

Carlson

[11] Patent Number: 5,152,704

[45] Date of Patent: Oct. 6, 1992

[54] WATER JET PROPULSION UNIT

[75] Inventor: Carl A. Carlson, Oakland, Calif.

[73] Assignee: Team Scarab, Inc., Santa Barbara, Calif.

[21] Appl. No.: 697,704

[22] Filed: May 9, 1991

[51] Int. Cl.[5] ..... B63H 11/00

[52] U.S. Cl. ..... 440/38; 440/112; 277/58

[58] Field of Search ..... 440/38, 43, 46, 47, 440/111, 112, 82, 83; 277/58, 59

[56] References Cited

U.S. PATENT DOCUMENTS 3,413,008 11/1968 Greiner ..... 277/58
3,726,531 4/1973 Pagan et al. ..... 440/112
4,448,425 5/1984 Von Bergen ..... 277/59

*Primary Examiner*—Jesus D. Sotelo

*Attorney, Agent, or Firm*—Harris, Kern, Wallen & Tinsley

[57] ABSTRACT

A water jet propulsion unit having a housing, a drive shaft, an impeller for mounting on the drive shaft, and a thrust bearing for supporting the drive shaft in the housing. The propulsion unit further includes a shaft seal unit for the shaft, with the housing having a forward end and a rear end, a bore with a longitudinal axis for slidingly receiving the shaft seal unit form the rear of the housing, with the shaft seal unit and the bearing carried on the shaft, a shoulder for preventing forward movement of the bearing in the bore along the axis beyond a predetermined position, and a lateral opening for access through the housing to the shaft seal unit, and a retainer moveable through the lateral opening for engagement with the shaft seal unit and the housing for limiting rearward movement of the shaft seal unit in the bore.

6 Claims, 3 Drawing Sheets

WATER JET PROPULSION UNIT

BACKGROUND OF THE INVENTION

This invention relates to propulsion units for boats and the like and in particular, to a new and improved water jet propulsion unit.

Water jets are widely used today for propulsion of watercraft, with the water jet being produced by an engine driven impeller in a housing rather than by a screw.

Water jet propulsion units are currently being produced by a large number of manufacturers, and a typical installation is shown in FIG. 1. The water jet propulsion unit 11 is mounted on the hull 12 of a boat, at the transom 13. Typically the water jet propulsion unit has a housing formed of a suction piece 14, a bowl 15, and a nozzle 16, with a reverse housing 17 and a reverse bucket 18 positioned at the outlet end of the nozzle. A planing plate 19 projects aft from the suction piece 14. An engine 20 is connected at the forward end of the suction piece of the housing by a mounting unit 21.

In operation, the engine drives an impeller in the bowl portion of the housing, with water being drawn in at an inlet 22 of the suction piece and driven outward through the nozzle 16 to provide the force which moves the vessel forward.

A typical water jet propulsion unit is shown in greater detail in FIG. 2, with a drive shaft 24 mounted in a thrust bearing 25 at the forward end of the housing and in another bearing 26 in a sleeve 27 of the bowl 15. The engine is connected at the forward end of the drive shaft and the impeller is carried at the aft end of the drive shaft. In this construction, the thrust bearing 25 is inserted into the housing from the forward end, resting against a shoulder 28 of the housing and being held in place by a bearing cap 29.

In the water jet propulsion units, it is often necessary to remove and service or replace the thrust bearing 25. With the present day construction as shown in FIG. 2, the thrust bearing must be moved forward relative to the housing. This requires either a forward movement of the engine or a rearward movement of the entire propulsion unit in order to remove the bearing cap and the thrust bearing. Both of these procedures are undesirable and time consuming.

SUMMARY OF THE INVENTION

Accordingly, it is an object of the present invention to provide a new and improved water jet propulsion unit in which the thrust bearing can be removed and replaced without requiring movement of the engine or movement of the portion of the propulsion unit connected to the boat.

It is a particular object of the invention to provide such a propulsion unit wherein the thrust bearing is inserted into the propulsion unit housing from the aft or rear end rather that from the forward end, and one wherein the drive shaft and thrust bearing can be removed from the fixed portion of the propulsion unit housing by merely removing the bowl and nozzle portion.

It is an additional object of the invention to provide such a unit utilizing a shaft seal unit for positioning around the shaft and within the housing, with the shaft, impeller, shaft seal unit and thrust bearing being insertable and removable as a unit from the rear end of the housing. A further object of the invention is to provide such a construction wherein the shaft seal unit can be fixed in position with a retainer insertable into the housing from a lateral opening.

It is a further object of the invention to provide such a unit in which a seal between the engine and the propulsion unit can be removed and replaced without movement of the engine or the portion of the propulsion unit connected to the boat.

These and other objects, advantages, features and results will more fully appear in the course of the following description.

The presently preferred embodiment of the water jet propulsion unit has a housing, a drive shaft, an impeller for mounting on the drive shaft, and a thrust bearing for supporting the drive shaft in the housing, and includes a shaft seal unit for the shaft, with the housing having a forward end and a rear end, a bore with a longitudinal axis for slidingly receiving the shaft seal unit from the rear of the housing, with the shaft seal unit and bearing carried on the shaft, a shoulder for preventing forward movement of the bearing in the bore along the axis beyond a predetermined position, and a lateral opening for access through the housing to the shaft seal unit, and a retainer moveable through the lateral opening for engagement with the shaft seal unit and the housing for limiting rearward movement of the shaft seal unit in the bore.

DESCRIPTION OF THE PREFERRED EMBODIMENT

Figure 1:
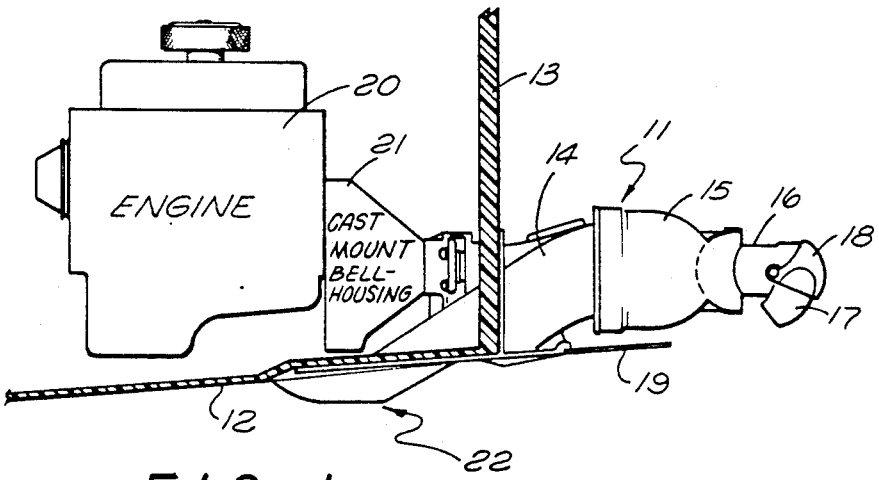
FIG. 1 is a partial side view illustrating a water jet propulsion unit installed in a boat.
Figure 2:
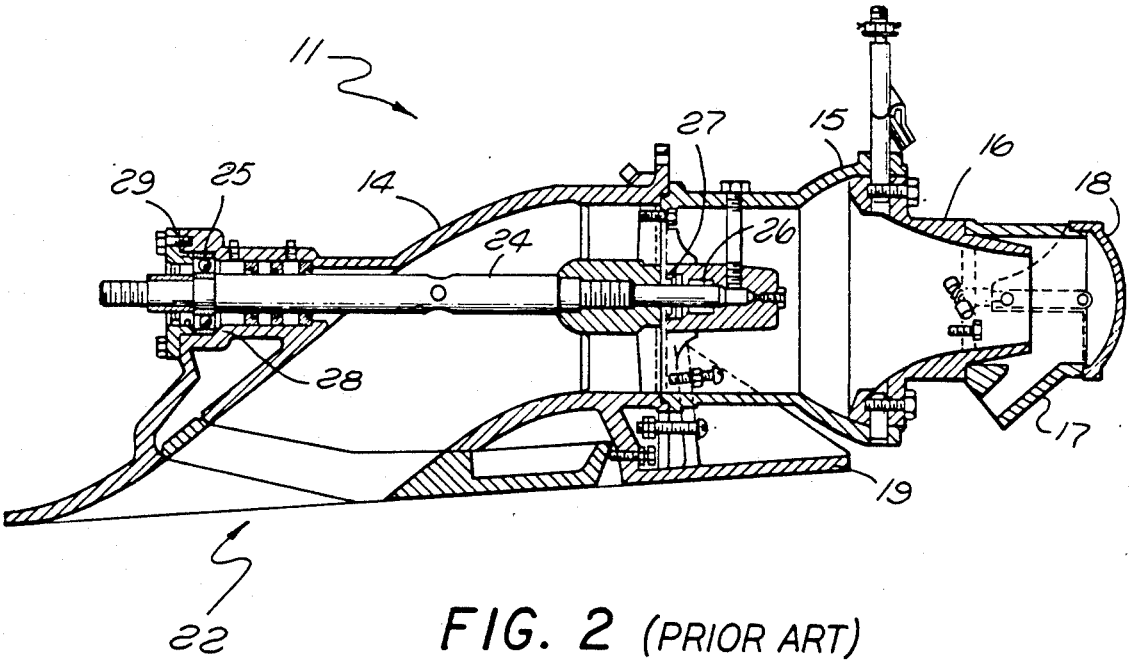
FIG. 2 (PRIOR ART)
FIG. 2 is a vertical sectional view of a prior art water jet propulsion unit.
Figures 3, 4:
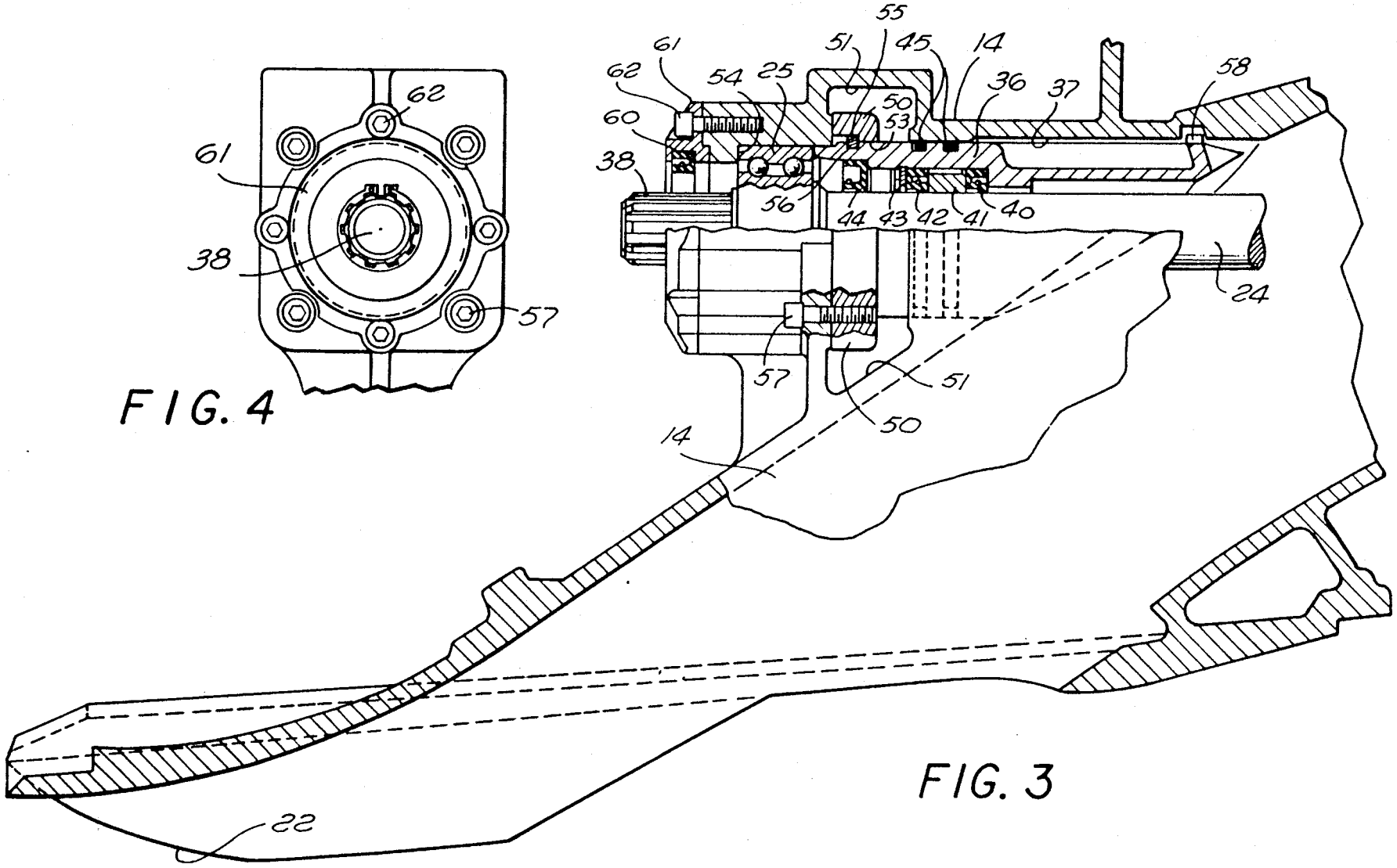
FIG. 3 is a vertical sectional view of a water jet propulsion unit incorporating the presently preferred embodiment of the invention.
FIG. 4 is a front end view of the propulsion unit of FIG. 3.
Figure 5:
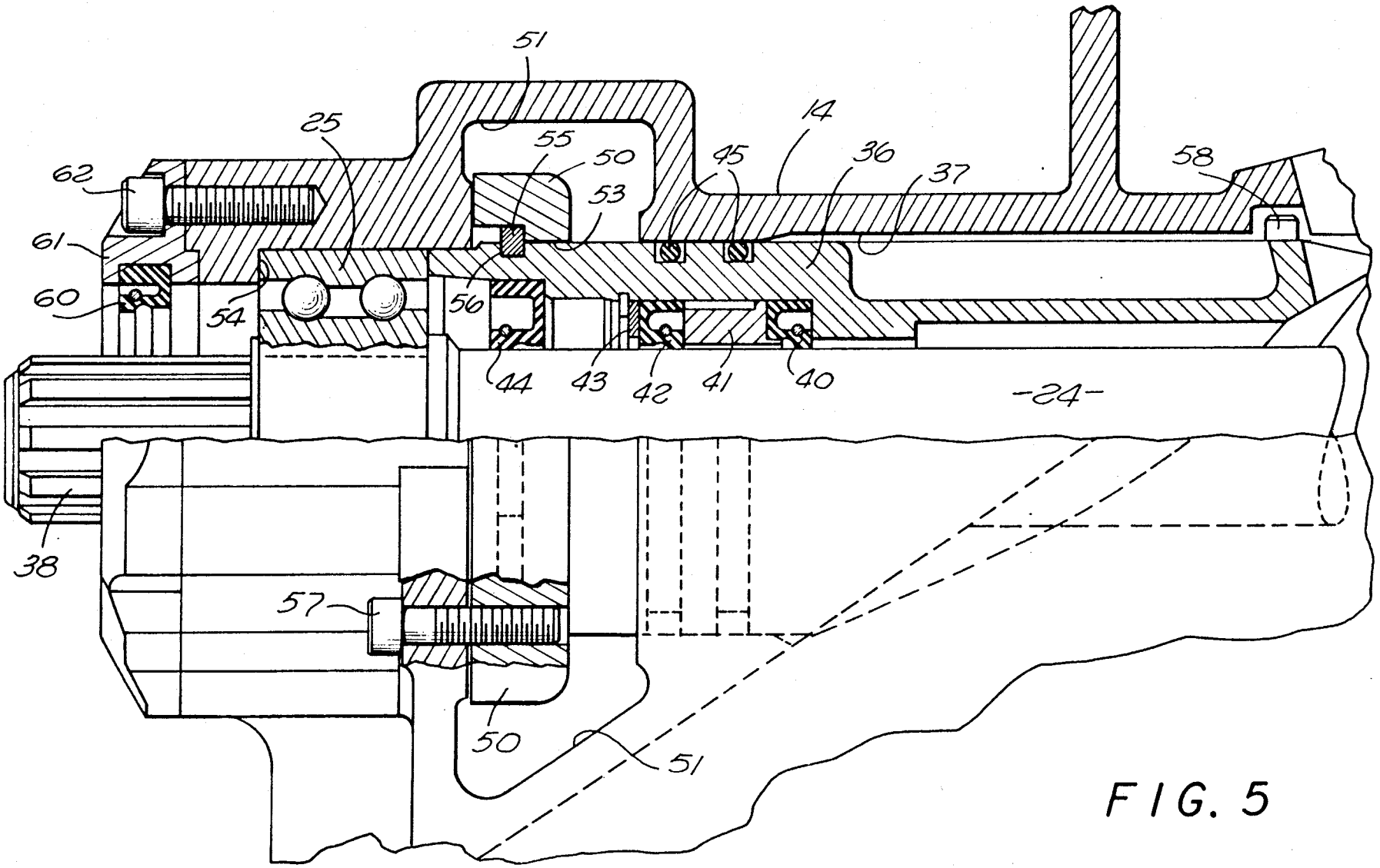
FIG. 5 is an enlarged partial view of the propulsion unit of FIG. 3.

A shaft seal unit 36 is positioned in a bore 37 in the housing suction piece 14. The shaft seal unit is designed for sliding insertion into the bore from the rear end (the right side of FIGS. 3 and 5) of the housing when the bowl and nozzle are removed from the suction piece. The forward end of the the shaft 24 has means for engagement with the engine and in the preferred embodiment illustrated, is a splined section 38 which permits sliding insertion of the drive shaft into the engine output drive.

The drive shaft 24 is inserted into a passage in the shaft seal unit and in the embodiment illustrated, carries a seal 40, a spacer 41, another seal 42, and a retainer ring 43. Another seal 44 is positioned forward of the seals 41, 42, and the thrust bearing 25 is carried on the shaft 24 between the seal 44 and the spline 38. Additional seals 45 are carried on the exterior of the shaft seal unit 36.

The drive shaft, impeller, seals, bearing and shaft seal unit may be assembled outside the housing suction piece 14. The shaft seal unit with shaft and bearing is inserted into the housing suction piece from the rear and the bowl of the housing is attached to the housing suction piece.

Prior to insertion of the shaft seal unit, a bearing retainer 50 is inserted into a lateral opening or cavity 51 in the housing suction piece. The bearing retainer 50 has a central opening 53 through which the thrust bearing and shaft seal unit can pass. After the forward end of the thrust bearing is seated against a shoulder 54 of the housing, a split ring retainer 55 is inserted through the lateral opening 51 and positioned in a retainer ring groove 56 in the shaft seal unit. The bearing retainer 50 is then bolted to the forward wall of the opening 51 by bolts 57. With this arrangement, the outer race of the thrust bearing 25 is clamped in place between the shoulder 54 of the housing and the forward end of the shaft seal unit 36. A pin 58 at the rear end of the shaft seal unit engages a mating slot in the housing for rotationally aligning the shaft seal unit in the housing.

Another seal 60 is positioned at the forward end of the housing for engaging a sleeve (not shown) of the engine output drive and is held in place by a split seal cap 61 and bolts 62.

With this construction, the thrust bearing 25 may be inserted from the rear of the housing and removed from the rear of the housing without moving the engine relative to the housing and without moving that portion of the housing which is attached to the boat. The bearing may be removed by removing the bolts 57. This permits moving the bearing retainer cap 50 from over the split ring 55 and removal of the split ring through the lateral opening. The bowl 15 of the housing is removed from the housing suction piece, and the shaft seal unit, shaft and thrust bearing are slid rearwardly from the housing suction piece. The bearing and seals can then be removed for servicing or replacement, after which the propulsion unit is reassembled.

The seal 60 can be removed and replaced while the drive shaft is out of the housing. The bolts 62 are removed, permitting removal of the pieces of the split seal cap 61. Then the seal 60 is removed laterally through the space between engine output drive and the propulsion unit housing. A new seal is placed in position before the drive shaft is reinserted. Then the split seal cap parts are bolted in place.

I claim:

1. In a water jet propulsion unit having a housing, a drive shaft, an impeller for mounting on said drive shaft, and a thrust bearing for supporting said drive shaft in said housing, the improvement comprising in combination:

a shaft seal unit for said shaft;

said housing having a forward end and a rear end and including first means defining a bore with a longitudinal axis for slidingly receiving said shaft seal unit from the rear of said housing, with said shaft seal unit and said bearing carried on said shaft, second means defining a shoulder for preventing forward movement of said bearing in said bore along said axis beyond a predetermined position, and third means defining a lateral opening for access through said housing to said shaft seal unit; and retainer means moveable through said lateral opening for engagement with said shaft seal unit and said housing for limiting rearward movement of said shaft seal unit in said bore.

2. A unit as defined in claim 1 wherein said retainer means includes:

a retainer ring for positioning in a ring groove in said shaft seal unit; and a retainer cap for positioning around said shaft seal unit with said retainer ring between said retainer cap and a wall of said housing; and means for clamping said retainer cap to said housing wall.

3. A unit as defined in claim 2 wherein said retainer ring is a split ring for insertion through said lateral opening of said housing.

4. A unit as defined in claim 3 wherein said means for clamping includes bolts for positioning in openings in said housing and threadedly engaging said retainer cap.

5. A unit as defined in claim 4 including a shaft seal and a seal cap carrying said shaft seal for mounting on the forward end of said housing around said shaft.

6. A unit as defined in claim 5 wherein said seal cap is a split seal cap, and including bolts for attaching said seal cap to said forward end of said housing.

* * * * *